US011891987B2

(12) United States Patent
Lehmann et al.

(10) Patent No.: US 11,891,987 B2
(45) Date of Patent: Feb. 6, 2024

(54) PISTON PUMP AND METHOD FOR OPERATING A PISTON PUMP

(71) Applicant: Schwing GmbH, Herne (DE)

(72) Inventors: Andreas Lehmann, Moers (DE); Friedrich Schwing, Herten (DE)

(73) Assignee: SCHWING GMBH, Herne (DE)

( * ) Notice: Subject to any disclaimer, the term of this patent is extended or adjusted under 35 U.S.C. 154(b) by 338 days.

(21) Appl. No.: 17/413,814

(22) PCT Filed: Dec. 3, 2019

(86) PCT No.: PCT/EP2019/083534

§ 371 (c)(1),
(2) Date: Jun. 14, 2021

(87) PCT Pub. No.: WO2020/120234

PCT Pub. Date: Jun. 18, 2020

(65) Prior Publication Data

US 2022/0025874 A1 Jan. 27, 2022

(30) Foreign Application Priority Data

Dec. 14, 2018 (DE) ..... 102018132270.4
Dec. 14, 2018 (DE) ..... 102018132309.3

(51) Int. Cl.
*F04B 1/02* (2006.01)
*F04B 17/00* (2006.01)
(Continued)

(52) U.S. Cl.
CPC ..... *F04B 1/02* (2013.01); *F04B 9/109* (2013.01); *F04B 15/02* (2013.01); *F04B 17/00* (2013.01)

(58) Field of Classification Search
CPC .. F04B 15/02; F04B 1/02; F04B 23/06; F04B 9/109; F04B 11/0058; F04B 17/00;
(Continued)

(56) References Cited

U.S. PATENT DOCUMENTS 2,660,955 A 12/1953 Kent et al.
3,279,383 A 10/1966 Smith
(Continued)

FOREIGN PATENT DOCUMENTS

DE 2063750 A1 7/1972
DE 2446805 A1 4/1976
(Continued)

OTHER PUBLICATIONS

International Preliminary Report on Patentability received for PCT Patent Application No. PCT/EP2019/083534, dated Jun. 24, 2021, 13 pages (8 pages of English Translation and 5 pages of Original Document).
(Continued)

*Primary Examiner* — Dominick L Plakkoottam
(74) *Attorney, Agent, or Firm* — Faegre Drinker Biddle & Reath LLP

(57) ABSTRACT

The invention relates to a method for operating a piston pump with a differential cylinder drive (1) with at least two differential cylinders (2, 3) for driving at least two conveying pistons movable in conveying cylinders, each conveying piston being driven via an associated differential cylinder (2, 3) of the differential cylinder drive (1) for operating the piston pump, with a hydraulic circuit (4) for driving the differential cylinder drive (1) by the action of hydraulic fluid. The invention also relates to a piston pump for carrying out the method.

19 Claims, 8 Drawing Sheets

Figure 1:
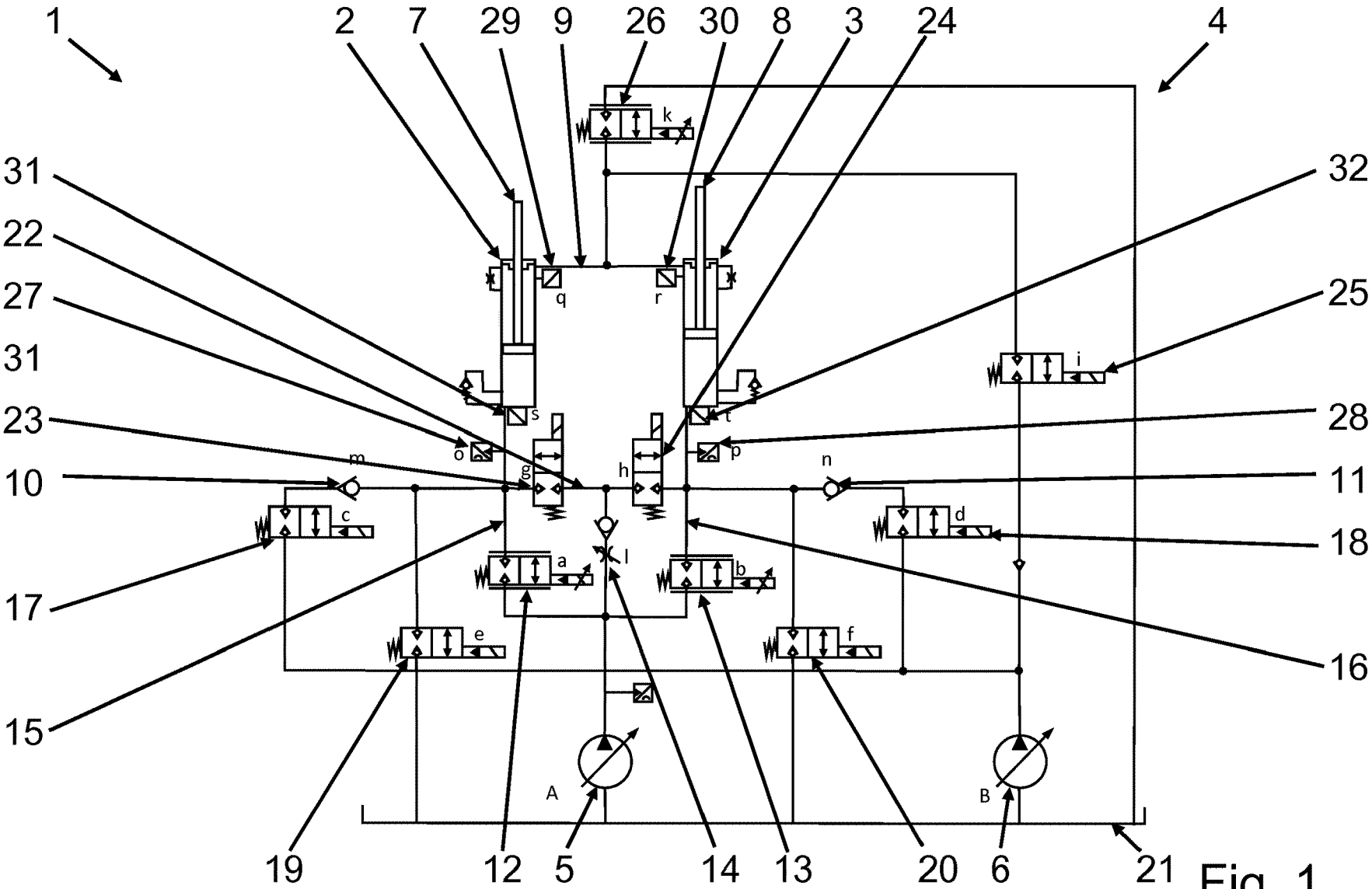

(51) Int. Cl.
*F04B 9/109* (2006.01)
*F04B 15/02* (2006.01)

(58) Field of Classification Search
CPC ..... F04B 2201/02; F04B 2201/0202; F04B 49/002; F04B 9/1172; F04B 9/1178
See application file for complete search history.

(56) References Cited

U.S. PATENT DOCUMENTS

| | | | | | |
|---|---|---|---|---|---|
| 3,749,525 | A | | 7/1973 | Hooper | |
| 3,981,622 | A | | 9/1976 | Hall et al. | |
| 4,343,598 | A | * | 8/1982 | Schwing | F04B 15/023 417/532 |
| 4,470,771 | A | | 9/1984 | Hall et al. | |
| 4,555,220 | A | * | 11/1985 | Hall | F04B 9/1172 417/342 |
| 5,325,761 | A | * | 7/1994 | Schwing | F15B 11/044 60/494 |
| 5,458,470 | A | * | 10/1995 | Mannhart | F04B 15/02 417/900 |
| 5,993,181 | A | | 11/1999 | Hudelmaier | |
| 6,644,930 | B1 | * | 11/2003 | Kuismanen | F04B 15/02 417/393 |
| 7,581,935 | B2 | * | 9/2009 | Hofmann | F04B 7/0241 417/532 |
| 9,651,033 | B2 | * | 5/2017 | Pirri | F04B 15/02 |
| 2010/0260615 | A1 | * | 10/2010 | Anderson | F04B 15/023 417/46 |
| 2011/0274572 | A1 | | 11/2011 | Schwing et al. | |
| 2015/0211503 | A1 | * | 7/2015 | Hofmann | F04B 23/06 417/275 |
| 2016/0084276 | A1 | * | 3/2016 | Schaber | B30B 15/161 60/415 |
| 2016/0084280 | A1 | * | 3/2016 | Maier | F15B 11/022 60/431 |
| 2017/0108014 | A1 | * | 4/2017 | Händle | B30B 1/323 |

FOREIGN PATENT DOCUMENTS

| | | | | |
|---|---|---|---|---|
| DE | 3041617 | A1 | 5/1981 | |
| DE | 3738359 | A1 | 5/1989 | |
| DE | 102004009362 | A1 | 10/2005 | |
| DE | 102005024174 | A1 | 12/2006 | |
| DE | 102015103180 | A1 | 9/2016 | |
| EP | 0167635 | A1 | 1/1986 | |
| EP | 0808422 | B1 | 11/1998 | |
| EP | 2387667 | B1 | 3/2013 | |
| EP | 3282124 | A1 | 2/2018 | |
| GB | 1480002 | A | 7/1977 | |
| GB | 2063381 | A | 6/1981 | |
| WO | WO-2010133270 | A1 * | 11/2010 | F04B 49/22 |

OTHER PUBLICATIONS

International Search Report and Written Opinion received for PCT Patent Application No. PCT/EP2019/083534, dated Mar. 6, 2020, 15 pages (7 pages of English Translation and 8 pages of Original Document).

* cited by examiner

PISTON PUMP AND METHOD FOR OPERATING A PISTON PUMP

CROSS-REFERENCE TO RELATED APPLICATION

This application is a national stage application of International Application No. PCT/EP2019/083534, filed 3 Dec. 2019, which claims priority to German Patent Application No. 10 2018 132 270.4, filed 14 Dec. 2018, and German Patent Application No. 10 2018 132309.3, filed 14 Dec. 2018, all of which are herein incorporated by reference in their entireties.

The invention relates to a method for operating a piston pump with a differential cylinder drive with at least two differential cylinders for driving at least two conveying pistons movable in conveying cylinders, each conveying piston being driven via an associated differential cylinder of the differential cylinder drive for operating the piston pump, with a hydraulic circuit for controlling or driving the differential cylinder drive by the action of hydraulic fluid.

When conveying concrete, for example, piston pumps are regularly used, which have two conveying cylinders, each with a piston. The cylinders draw the pasty mass to be conveyed in a suction stroke, for example from a filling hopper, and then convey the sucked-in pasty mass in a pumping stroke into a conveying line connected to the piston pump. The pistons of the two cylinders are operated in opposite directions in order to convey pasty mass into the conveying line as uniformly as possible. The conveying line of such a pumping device can be of considerable length. It is often part of a crane boom and serves to convey the pasty mass from the location of the pumping device to remote ends of the construction site. The length of the conveying line means that even the smallest interruptions in the flow of the pasty mass will cause the conveying line to swing considerably due to the inertia of the mass. For this reason, efforts have long been made to develop pumps and processes that allow continuous conveying of the pasty mass.

U.S. Pat. No. 3,749,525 A discloses a pump designed to convey a material under pressure. For this purpose, the pump has rotary valves associated with the conveying cylinders, at which three connection openings are selectively opened or closed. The three connection openings are an inlet opening, which is connected to the conveying cylinder, an outlet opening, which is connected to a conveying line, and a filling opening, which is connected to a filling hopper. The rotary valves have at least three switching positions and are switched simultaneously in opposite directions to each other by an actuator. During the simultaneous closing of the feed opening and the discharge opening by the two rotary valves, the continuous flow from the conveying cylinders is interrupted. A pressure drop caused by this is compensated by a balancing cylinder, which ensures continuous conveying in the conveying line even when the conveying pistons in the conveying cylinders periodically change direction. The disadvantages of such a solution are, on the one hand, the complex design with a third cylinder and the complicated control of the three cylinders in order to maintain continuous conveying in the conveying line.

In U.S. Pat. No. 3,279,383 A, a pump is described having at least two conveying cylinders with conveying pistons movable therein, each conveying cylinder being assigned a respective rotary slide valve which has a slide valve housing and a valve member rotatable therein about an axis of rotation, the slide valve housing having at least three connection openings. The three connection openings are an inlet opening connected to the conveying cylinder, an outlet opening connected to a conveying line, and a filling opening connected to a filling hopper. The valve member optionally closes or releases the filling opening or the outlet opening in two switching positions.

By coordinating the movements of the two conveying pistons moving in the conveying cylinders, a continuous conveyance of material in the conveying line is to be maintained. As no pre-compression of the material to be conveyed in the conveying cylinders is possible via the only two switching positions of the rotary valves, interruptions in the conveying flow of the pasty mass occur when the full conveying cylinders are opened prior to the pumping process, which lead to considerable swiveling movements of the conveying line due to the mass inertia.

Further efforts to achieve continuous conveyance of material in a two-cylinder piston pump are disclosed in EP 2 387 667 B1. Here, an inlet slide valve and an outlet slide valve are assigned to each conveying cylinder. The solution described here has the advantage that the slide valves can be opened and closed under optimum pressure conditions. However, a suitable hydraulic circuit for driving the conveying pistons in the conveying cylinders is not described here.

EP 3 282 124 A1 also discloses a solution for continuous conveyance of material in a two-cylinder piston pump. Here, an inlet slide valve is assigned to each conveying cylinder, and an outlet slide valve is provided which can be switched to three switching positions, whereby simultaneous conveying via the two conveying pistons of the conveying cylinders is possible in a middle position.

A hydraulic circuit for switching a differential cylinder drive for driving the conveying pistons in the conveying cylinders of a piston pump is proposed in EP 0 808 422 B1. The differential cylinders of the differential cylinder drive disclosed here drive the conveying pistons moving in the conveying cylinders of the piston pump during pumping operation of the piston pump. For this purpose, the differential cylinders are supplied with a hydraulic fluid flow from a main hydraulic pump by the proposed hydraulic circuit. The main hydraulic pump drives the differential cylinders when material to be conveyed is sucked into the conveying cylinders and when sucked material is discharged from the conveying cylinders. In addition, a further hydraulic pump is provided in the proposed hydraulic circuit, which pressurizes the differential cylinders with hydraulic fluid via the hydraulic circuit when material to be conveyed is pre-compressed in the conveying cylinders. A disadvantage of the solution described here is that the pressure of the main hydraulic pump exceeds the pressure of the additional hydraulic pump. In this way, no sufficient pre-compression can take place in the conveying cylinders of the piston pump, since the lower pressure of the auxiliary hydraulic pump is not sufficient to achieve pre-compression of the conveyed material in the conveying cylinders, which, when switching over to the pumping process for discharging the conveyed material from the conveying cylinder, prevents back-sliding of conveyed material from the conveying line, due to the further compression of conveyed material in the conveying cylinder, and vibrations caused thereby. In addition, the proposed two-way valve on the drive lines between the main hydraulic pump and the differential cylinders of the differential cylinder drive allows the conveying pistons of the conveying cylinders to be switched over only abruptly for the discharge of sucked in material. When the differential cylinders of the differential cylinder drive are abruptly acted upon by the main hydraulic pump, further vibrations of the conveying line are caused. In one embodiment, it is also proposed to drive the differential cylinders of the differential cylinder drive via separate hydraulic pumps. In this case, however, the timing of the switching of the control valves and the drive power of the two separate hydraulic pumps is particularly difficult. Continuous conveyance of material with a piston pump is therefore not possible with the hydraulic circuits proposed here for the differential cylinder drive.

It is therefore the task of the invention to specify an improved method for operating a piston pump with a differential cylinder drive controlled via a hydraulic circuit, which enables simple, error-free and uniform, i.e. continuous, conveying. It is also intended to provide a simplified piston pump which offers continuous conveyance of conveyed material with inversely conveying pistons in the conveying cylinders.

This task is solved by a method for operating a piston pump having the features of claim 1. According to the invention, it is provided that the method comprises the following cyclically performed steps:

Suction of material to be conveyed by means of a first conveying cylinder by driving the associated differential cylinder and simultaneous discharging of material to be conveyed by means of a second conveying cylinder by driving the associated differential cylinder, pre-compression of the sucked-in material by means of the first conveying cylinder by driving the associated differential cylinder and simultaneous discharging the material by means of the second conveying cylinder by driving the associated differential cylinder, discharge of the pre-compressed material by means of the first conveying cylinder by driving the associated differential cylinder and simultaneous suction of material to be conveyed by means of the second conveying cylinder by driving the associated differential cylinder, and discharge of the material by means of the first conveying cylinder by driving the associated differential cylinder and simultaneous pre-compression of the sucked-in material by means of the second conveying cylinder by driving the associated differential cylinder. This method provides a simple, error-free and uniform, i.e. continuous, conveyance of material to be conveyed.

Advantageous embodiments and further developments of the invention result from the dependent claims. It should be noted that the features listed individually in the claims can also be combined with one another in any desired and technologically useful manner and thus reveal further embodiments of the invention.

A particularly advantageous embodiment of the invention relates to the fact that the pre-compression is divided into at least two phases, wherein in a first phase the hydraulic circuit effects the pre-compression of the sucked-in material in the conveying cylinder at a first conveying piston speed by acting on to the associated differential cylinder with the hydraulic fluid at a first volume flow and a first pressure and in a second, subsequent phase the hydraulic circuit effects the pre-compression of the sucked-in material in the conveying cylinder at a second conveying piston speed, which is lower than the first conveying piston speed, by acting on the associated differential cylinder with the hydraulic fluid at a second volume flow which is lower than the first volume flow, and at a second pressure, which is higher than the first pressure.

In that the pre-compression is divided into at least two phases, wherein in a first phase the hydraulic circuit effects the pre-compression of the sucked-in material in the conveying cylinder at a first conveying piston speed by acting on the associated differential cylinder with the hydraulic fluid at a first volume flow and a first pressure, and in a second, subsequent phase, the hydraulic circuit effects the pre-compression of the sucked-in material in the conveying cylinder at a second conveying piston speed, which is lower than the first conveying piston speed, by acting on the associated differential cylinder with the hydraulic fluid at a second volume flow, which is lower than the first volume flow, and at a second pressure, which is higher than the first pressure, continuous conveying, which is improved in comparison with the state of the art, can be achieved.

In the first phase of pre-compression, large quantities of hydraulic fluid are usually required to pre-compress the conveyed material in the conveying cylinders. In particular, if the filling level of the conveying cylinder at the end of the suction is low, i.e., the suction conveying cylinder is filled with air as well as thick matter, the time provided for pre-compression and the available hydraulic pressure are often not sufficient to carry out pre-compression in such a way that the pre-compressed material is subjected to the same pressure as the material in the discharge conveying cylinder. Pressure fluctuations in the conveying line caused by this prevent continuous conveying. This is where the invention comes in, in that in the first phase for pre-compression the hydraulic circuit applies a first volume flow and a first pressure to the differential cylinders. At the beginning of the pre-compression, usually only the sucked-in air in the conveying cylinder is to be compressed. Therefore, a low hydraulic pressure is sufficient for the first phase of pre-compression, but a longer piston travel may have to be covered, which means that a larger hydraulic fluid volume must also be provided for this first phase of pre-compression. When the first phase of pre-compression is complete, the pressure of the material being conveyed in the conveying cylinders must still be raised to the pressure level in the conveying line. For this purpose, in the second phase of pre-compression, the differential cylinders are driven by the hydraulic circuit at a lower, second conveying piston speed compared to the first conveying piston speed via the associated differential cylinder. For this purpose, a lower, second volumetric flow rate compared to the first volumetric flow rate and a higher, second pressure compared to the first pressure are used. This pre-compression, which is divided into two phases, ultimately makes it possible to achieve continuous conveyance of the material to be conveyed, effectively reducing backsliding of the material in the conveying line and thus vibrations of the conveying line. The lower first pressure in the first phase, which is applied to the assigned differential cylinder by the hydraulic circuit at the start of pre-compression, makes a particular contribution to this. This can prevent the conveying piston in the conveying cylinder from hitting the material being conveyed, which is compressed too quickly, at a too high pressure and a too high conveying piston speed. The transition between the first phase of pre-compression and the second phase of pre-compression can be continuous to further reduce vibrations of the conveying line.

A particularly advantageous embodiment is one which provides that the hydraulic circuit comprises at least one main hydraulic source, in particular at least one main hydraulic pump, for driving, i.e. for applying hydraulic fluid to the differential cylinders, the associated differential cylinder being acted upon by the main hydraulic source, in particular by the main hydraulic pump, via the hydraulic circuit in order to pre-compress the sucked-in material in one conveying cylinder and the associated differential cylinder being acted upon by the main hydraulic source, in particular by the main hydraulic pump, with equal pressure in order to simultaneously discharge the material from the other conveying cylinder. A piston pump can be operated for the continuous conveying of material by applying an equal pressure to the assigned differential cylinder in one conveying cylinder to pre-compress the material being sucked-in and by applying an equal pressure to the assigned differential cylinder in the other conveying cylinder via the hydraulic circuit of the main hydraulic pump to discharge the material at the same time. Simultaneous pressurization of the differential cylinders in the discharge direction (for pre-compression or for discharging material) by an identical pressure provided by the main hydraulic pump makes it particularly easy to equalize the pressure levels in the conveying cylinders during pre-compression. In pre-compression, the application of equal pressure from the same pressure source ensures that the pressure ratios in the conveying cylinder are easily matched to the pressure ratios in the conveying line. By adapting the pressure ratios, it is very easy to achieve continuous conveyance of material through a two-cylinder piston pump, effectively preventing material from sliding back in the conveying line and thus preventing vibrations in the conveying line.

According to an advantageous embodiment of the invention, it is provided that after the pre-compression of the sucked-in material by means of a conveying cylinder by driving the respectively assigned differential cylinder via the hydraulic circuit, a discharge of the material by means of the first and the second conveying cylinder takes place simultaneously by parallel driving of the assigned differential cylinders, before a suction of material to be conveyed by means of a conveying cylinder by driving the respectively assigned differential cylinder via the hydraulic circuit follows again. The parallel drive of the assigned differential cylinders allows simultaneous discharge of material to be conveyed via both conveying pistons of the piston pump. With parallel conveying from both conveying cylinders, a smooth transition can be established in the transfer of the conveying flow generated by the piston pump in the conveying line between the two conveying cylinders.

A particularly advantageous embodiment of the invention relates to the fact that the hydraulic circuit comprises at least one main hydraulic source, in particular a main hydraulic pump, for driving the differential cylinders, in particular for supplying the differential cylinders with hydraulic fluid, when material to be conveyed is sucked into the conveying cylinders by the conveying pistons and sucked material is discharged from the conveying cylinders by the conveying pistons, and an auxiliary hydraulic source, in particular an auxiliary hydraulic pump, for driving the differential cylinders when material to be conveyed is pre-compressed in the conveying cylinders in the time between the suction of material to be conveyed and the discharge of pre-compressed material. In order not to divert too much hydraulic fluid volume from the main hydraulic source in this first phase and thereby cause conveying pressure fluctuations in the conveying line, it is proposed to connect the auxiliary hydraulic source. For this purpose, one hydraulic source with sufficient conveying volume is generally sufficient. The oil pressure provided by the auxiliary hydraulic source, on the other hand, need not be too high, in particular it need not reach the high pressure of the discharging conveying cylinder. In the hydraulic circuit provided, an additional hydraulic source is provided for this purpose, which, at least in the first phase of pre-compression, drives the differential cylinders together with the main hydraulic source to compress the conveyed material in the conveying cylinders. The first phase of pre-compression is completed when the auxiliary hydraulic source no longer contributes to increasing the pressure level in the conveying cylinder. The hydraulic pressure required for this purpose can be provided by the main hydraulic source without causing a drop in hydraulic pressure at the associated differential cylinder of the simultaneous conveying conveying cylinder, because the amount of oil required in this second phase is only small. The fact that in this second phase of pre-compression only the main hydraulic source pressurizes the differential cylinders of the differential cylinder drive for driving the conveying pistons in the conveying cylinders means that the pressure level during pre-compression in the one conveying cylinder can be easily adapted to the pressure level of the already conveying conveying cylinder and thus to the pressure level in the conveying line.

According to an advantageous embodiment of the invention, it is provided that the pre-compression is divided into at least two phases, wherein in a first phase the auxiliary hydraulic source, in particular the auxiliary hydraulic pump, and the main hydraulic source, in particular the main hydraulic pump, effect a pre-compression of the sucked-in material in the relevant conveying cylinder by driving the associated differential cylinder, and in a second, subsequent phase only the main hydraulic source, in particular only the main hydraulic pump, effecting the pre-compression of the sucked-in material in the conveying cylinder by driving the differential cylinder. In the first phase of pre-compression, large amounts of hydraulic fluid are usually required to pre-compress the material being conveyed in the conveying cylinders. In particular, if the filling level of the conveying cylinder at the end of suction is low, i.e. the suction conveying cylinder is filled with air as well as thick matter, the time period provided for pre-compression and the available hydraulic pressure are often not sufficient to carry out pre-compression in such a way that the pre-compressed material is subjected to the same pressure as the material conveyed in the discharge conveying cylinder. Pressure fluctuations in the conveying line caused by this prevent continuous conveying. This is where the invention comes in, in that in the first phase for pre-compression, the hydraulic circuit applies hydraulic fluid to the differential cylinders through the main hydraulic pump and an auxiliary hydraulic pump. At the beginning of the pre-compression, usually only the sucked-in air in the conveying cylinder is to be compressed. A low hydraulic pressure is therefore sufficient for the first phase of pre-compression, but a longer piston stroke may have to be covered, i.e. a larger hydraulic fluid volume must also be provided for this first phase of pre-compression. This pre-compression, which is divided into two phases, makes it very easy to achieve continuous conveyance of material by a two-cylinder piston pump, effectively preventing material from sliding back in the conveying line and thus preventing vibrations in the conveying line.

A particularly advantageous embodiment of the invention relates to the fact that by the application of equal pressure by the main hydraulic source, in particular by the main hydraulic pump, an equal pressure is established in the differential cylinders at the end of the second phase of the pre-compression before the discharge of pre-compressed material from the conveying cylinder that has completed the pre-compression is started. By setting equal pressure at the end of the second phase in the pre-compression, pressure conditions can thus be created in the conveying cylinders that prevent material from sliding back from the conveying line and thus prevent vibrations of the conveying line at the beginning of the discharge of pre-compressed material.

A particularly advantageous embodiment of the invention provides that the differential cylinders for accelerating the suction of material to be conveyed into the conveying cylinders are additionally acted upon by the auxiliary hydraulic source, in particular by the auxiliary hydraulic pump, for driving the conveying pistons by the hydraulic circuit during suction. With the acceleration of the suction by the auxiliary hydraulic source or the auxiliary hydraulic pump, the suction process of the conveying pistons can take place faster than the pumping process, so that the time for the pre-compression of conveyed material in the conveying cylinders and preferably also the time of parallel conveying by both conveying cylinders can be balanced. With the use of the auxiliary hydraulic source, in particular the auxiliary hydraulic pump, during the pre-compression and during the suction, the auxiliary hydraulic source, preferably a hydraulic pump, can be used for two different tasks at the same time, so that only one unit, preferably an additional pump, is required here for the accelerated suction and the improved pre-compression.

An advantageous embodiment of the invention provides that the additional loading of the differential cylinders for accelerating the suction of material to be conveyed into the conveying cylinders from the auxiliary hydraulic source, in particular from the auxiliary hydraulic pump, is effected on the rod-side working surfaces of the differential pistons of the differential cylinders, the rod sides of the differential pistons being connected via a swing line which is connected by the hydraulic circuit to the auxiliary hydraulic source, in particular to the auxiliary hydraulic pump, for loading with hydraulic fluid. By applying fluid to the differential cylinders at the rod-side working surfaces of the differential pistons, it is very easy to achieve additional acceleration during suction by the auxiliary hydraulic source, in particular by the auxiliary hydraulic pump. For this purpose, the auxiliary hydraulic source, in particular the auxiliary hydraulic pump, advantageously acts on the swing line that connects the rod sides of the differential pistons to one another.

A particularly advantageous embodiment is one which provides that the differential cylinders for driving the conveying pistons are acted upon on the piston-side working surfaces of the differential pistons by the hydraulic circuit when material to be conveyed is discharged from the conveying cylinders by the main hydraulic source, in particular by the main hydraulic pump. When the differential pistons are acted upon on the rod side by hydraulic fluid for accelerating the suction by the auxiliary hydraulic source, in particular by the auxiliary hydraulic pump, it is of particular advantage if the differential cylinders for driving the conveying pistons are acted upon on the piston-side working surfaces of the differential pistons by the main hydraulic source, in particular by the main hydraulic pump, when material to be conveyed is discharged from the conveying cylinders. With the differential pistons being acted upon on both sides by the main hydraulic source, in particular by the main hydraulic pump, and the auxiliary hydraulic source, in particular the auxiliary hydraulic pump, which feeds in additional hydraulic fluid at the swing line, the suction of material to be conveyed can be accelerated simply and effectively. In addition to the swing fluid from the rod side of one differential cylinder, the rod side of the other differential cylinder is supplied with additional hydraulic fluid from the auxiliary hydraulic source, in particular from the auxiliary hydraulic pump. This is a simple way of achieving a particularly effective acceleration of the suction process.

An advantageous embodiment provides that the auxiliary hydraulic source, in particular the auxiliary hydraulic pump, during the first phase of pre-compression provides a higher volume flow of hydraulic fluid but a lower pressure compared to the main hydraulic source, in particular the main hydraulic pump, via the hydraulic circuit for driving the differential cylinders. The higher volumetric flow rate of hydraulic fluid provided by the auxiliary hydraulic source, in particular the auxiliary hydraulic pump, during the first phase of pre-compression for driving the differential cylinders enables rapid compression of the sucked-in material in the conveying cylinders, even at low filling levels, without the conveying pressure in the conveying line collapsing.

According to a preferred embodiment of the invention, it is provided that a check valve in the hydraulic circuit closes as soon as a pressure of the hydraulic fluid is present during the pre-compression, which is higher than the pressure provided by the auxiliary hydraulic source, in particular by the auxiliary hydraulic pump, whereby the closing of the check valve representing the transition from the first phase of the pre-compression to the second phase of the pre-compression. With the closing of the check valve in the hydraulic circuit, the first phase of pre-compression can be completed in a simple manner so that the auxiliary hydraulic source, in particular the auxiliary hydraulic pump, ceases to drive the differential cylinders of the differential cylinder drive for pre-compression. As soon as a pressure is present at the check valve during pre-compression that is higher than the pressure provided by the auxiliary hydraulic source, in particular by the auxiliary hydraulic pump, the check valve closes and pre-compression is completed by the main hydraulic source, in particular by the main hydraulic pump, in the second phase.

A particularly advantageous embodiment provides that the auxiliary hydraulic source, in particular the auxiliary hydraulic pump, presses the check valve open while the differential cylinders are being acted upon in the first phase of the pre-compression. By pressing open the check valve during the first phase of pre-compression, the auxiliary hydraulic source, in particular the auxiliary hydraulic pump, can very easily make its contribution for driving the differential cylinders during pre-compression.

A particularly advantageous embodiment of the invention provides that drive lines between the differential cylinders and the main hydraulic source, in particular the main hydraulic pump, are controllable via proportional valves, wherein the proportional valves are opened slowly at the end of the second phase of pre-compression after equal pressure has been reached in the differential cylinders for discharging pre-compressed material from the conveying cylinders and are closed slowly after the material is discharged from the conveying cylinders. By slowly opening the proportional valves, a particularly smooth transition between pre-compression and discharge of the pre-compressed material to be conveyed can be realized. The slow closing of the proportional valves also ensures a smooth transition into the suction process after the pumping process has been completed.

According to an advantageous embodiment of the invention, it is provided that the differential cylinders for pre-compression of material to be conveyed in the conveying cylinders by the conveying pistons are acted upon by the hydraulic fluid by the auxiliary hydraulic source, in particular by the auxiliary hydraulic pump, via a check valve of the hydraulic circuit and simultaneously by the main hydraulic source, in particular by the main hydraulic pump, via a flow control valve of the hydraulic circuit. By acting on the differential cylinders via the check valve it can be ensured that the auxiliary hydraulic source, in particular the auxiliary hydraulic pump, provides additional hydraulic fluid for rapid piston movement during the first phase of pre-compression. By acting on the differential cylinders from the main hydraulic source, in particular from the main hydraulic pump, via the flow control valve ensures that only a defined volume flow from the main hydraulic source, in particular from the main hydraulic pump, is used for pre-compression. With the volume flow limited via the flow control valve, pre-compression to the pressure level in the conveying line can be implemented without any significant pressure fluctuations occurring in the conveying line as a result of pre-compression via the main hydraulic source, in particular via the main hydraulic pump. This makes it possible to raise the pressure level in the conveying cylinders to the pressure level in the conveying line in a simple manner by pre-compressing the material being conveyed. This effectively prevents the material being conveyed from sliding back in the conveying line, thus preventing vibrations in the conveying line.

Particularly preferred is an embodiment which provides that during the pre-compression of material to be conveyed in one conveying cylinder, the other conveying cylinder for discharge of material to be conveyed is driven via the associated differential cylinder, this differential cylinder being acted upon hydraulic fluid from the hydraulic circuit by the main hydraulic source, in particular by the main hydraulic pump, the hydraulic circuit for this purpose supplying the differential cylinder from the main hydraulic source, in particular the main hydraulic pump with hydraulic fluid via a drive line branching off upstream of the flow control valve. The associated differential cylinder can be driven by the main hydraulic source, in particular by the main hydraulic pump, when material is discharged from the conveying cylinder without the branching of hydraulic fluid from the drive line leading to significant fluctuations in conveying pressure when the material is discharged into the conveying line.

A particularly advantageous embodiment of the invention relates to the fact that, for simultaneous discharge of material to be conveyed from the conveying cylinders, the associated differential cylinders are supplied with the hydraulic fluid in parallel via separate drive lines from the main hydraulic source, in particular from the main hydraulic pump, bypassing the flow control valve from the hydraulic circuit. By acting on the assigned differential cylinders via separate drive lines, a simultaneous discharge of conveyed material from the conveying cylinders can be achieved by simultaneously driving the differential cylinders via the main hydraulic source, in particular via the main hydraulic pump. By bypassing the flow control valve, the drive power of the main hydraulic source, in particular the main hydraulic pump, can be easily divided by the hydraulic circuit between the differential cylinders driven in parallel.

Furthermore, it is an object of the invention to provide a piston pump, described above and in more detail below, for carrying out the method, having a differential cylinder drive with at least two differential cylinders for driving at least two conveying pistons of the piston pump movable in conveying cylinders, each conveying piston being driven via an associated differential cylinder of the differential cylinder drive for operating the piston pump, having a hydraulic circuit for controlling the differential cylinder drive and/or for driving the differential cylinder drive by the action of hydraulic fluid.

A particularly advantageous embodiment of the piston pump relates to the fact that the hydraulic circuit is set up to effect, in a first phase, a pre-compression of the sucked-in material in a conveying cylinder at a first conveying piston speed by acting on the associated differential cylinder with the hydraulic fluid at a first volume flow and a first pressure and in a second, subsequent phase, a pre-compression of the sucked-in material in the conveying cylinder at a second conveying piston speed which is lower than the first conveying piston by acting on the assigned differential cylinder with the hydraulic fluid to at a second volume flow which is lower than the first volume flow and a second pressure, which is higher than the first pressure.

A preferred embodiment of the piston pump relates to the fact that the hydraulic circuit has at least one main hydraulic source, in particular a main hydraulic pump, for driving the differential cylinders, wherein the differential cylinders can be at least temporarily simultaneously supplied with hydraulic fluid under equal pressure by the one main hydraulic source, in particular by the one main hydraulic pump, for driving the conveying pistons from the hydraulic circuit. By applying the same pressure, provided by the main hydraulic pump, to the associated differential cylinders, it is particularly easy to equalize the pressure levels in the conveying cylinders during pre-compression, as explained above. The application of equal pressure from the same pressure source ensures that the pressure ratios in the conveying cylinders can be easily matched to the pressure ratios in the conveying line during pre-compression. By adapting the pressure ratios, a continuous conveying of material through the piston pump can be achieved simply and effectively, effectively preventing the material from sliding back in the conveying line and thus preventing vibrations in the conveying line.

A particularly preferred embodiment of the piston pump relates to the fact that the hydraulic circuit comprises at least:

- a main hydraulic source, in particular a main hydraulic pump, for driving the differential cylinders when material to be conveyed is sucked into the conveying cylinders and when sucked material is discharged from the conveying cylinders, and
- an auxiliary hydraulic source, in particular an auxiliary hydraulic pump, for driving the differential cylinders upon pre-compression of material to be conveyed in the conveying cylinders prior to discharge of pre-compressed material. The invention proposes that each of the differential cylinders, at least at times, can be supplied with the hydraulic fluid simultaneously from the main hydraulic source, in particular from the main hydraulic pump, and the auxiliary hydraulic source, in particular the auxiliary hydraulic pump, from the hydraulic circuit for pre-compression in the associated conveying cylinder.

Further features, details and advantages of the invention will be apparent from the following description and from the drawings, which show examples of embodiments of the invention. Corresponding objects or elements are provided with the same reference signs in all figures. They show:

FIG. 1 Hydraulic circuit according to the invention,

FIGS. 2 to 7 hydraulic circuit in various switching positions and

Figure 8:
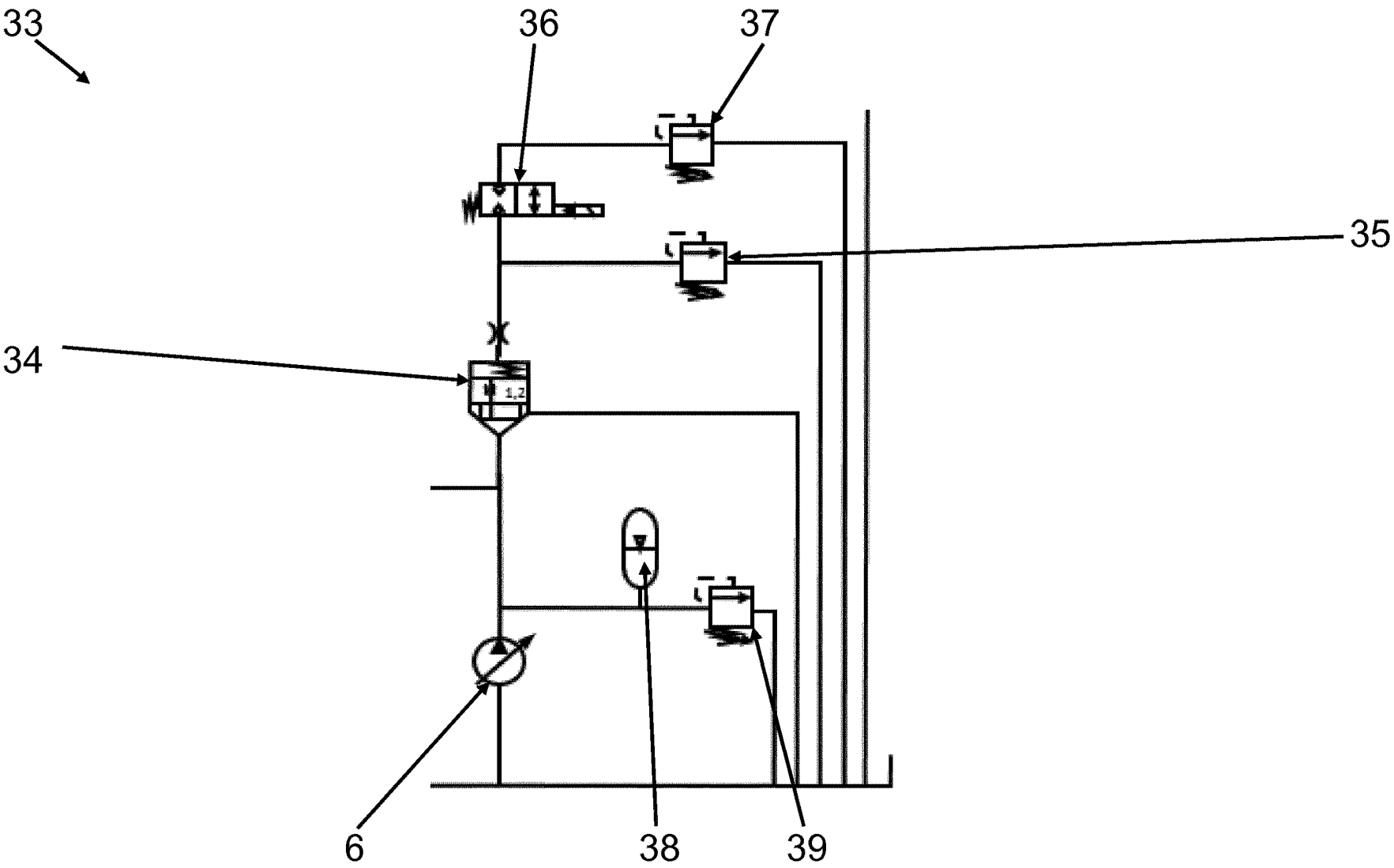

FIG. 8 Pressure limiting circuit for auxiliary hydraulic pump.

FIG. 1, denoted by the reference sign 1, shows a differential cylinder drive 1 with a hydraulic circuit 4 for operating a piston pump according to the invention. The differential cylinder drive 1 comprises at least two differential cylinders 2, 3 for driving at least two conveying pistons of a piston pump which are movable in conveying cylinders. Each of the conveying pistons is driven via an associated differential cylinder 2, 3 of the differential cylinder drive 1 for operating the piston pump. The piston pump comprises the hydraulic circuit 4 for switching the differential cylinder drive 1. The hydraulic circuit 4 has at least one main hydraulic source 5, which is preferably designed as a main hydraulic pump 5, for driving the differential cylinders 2, 3 when material to be conveyed is sucked into the conveying cylinders by the conveying pistons. The main hydraulic source 5 may be designed as a main hydraulic pump 5, as indicated in the figures. Alternatively, the main hydraulic source 5 may also be designed as a hydraulic accumulator, which is preferably charged by a hydraulic pump. The discharge of sucked-in material from the conveying cylinders by the conveying pistons is also performed by driving the differential cylinders 2, 3 via the main hydraulic pump 5. The hydraulic circuit 4 also has an auxiliary hydraulic source 6, which is preferably designed as an auxiliary hydraulic pump 6, for driving the differential cylinders 2, 3 when material to be conveyed is pre-compressed in the conveying cylinders by the conveying pistons. The auxiliary hydraulic source 6 may be designed as an auxiliary hydraulic pump 6, as indicated in the figures. Alternatively, the auxiliary hydraulic source 6 can also be designed as a hydraulic accumulator, which is preferably charged by the main hydraulic pump 5 and/or another hydraulic pump. In a particularly preferred embodiment, a hydraulic pump charges the main hydraulic source 5 designed as a hydraulic accumulator and the auxiliary hydraulic source 6 designed as a hydraulic accumulator. Pre-compression advantageously takes place in time between suction of material to be conveyed into the conveying cylinders and discharge of pre-compressed material from the conveying cylinders and ensures continuous conveyance of material to be conveyed by the piston pump. To accelerate the suction of material to be conveyed into the conveying cylinders, the auxiliary hydraulic pump 6 can also additionally pressurize the differential cylinders 2, 3 to drive the conveying pistons. By acting on the differential cylinders 2, 3 to accelerate the suction, the auxiliary hydraulic pump 6 can shorten the suction via the hydraulic circuit 4. The hydraulic circuit 4 shown has two proportional valves 12, 13 by means of which the drive lines 15, 16 between the differential cylinders 2, 3 and the main hydraulic pump 5 can be controlled. With the use of proportional valves 12, 13, the differential cylinders 2, 3 can be slowly pressurized with hydraulic pressure for discharging pre-compressed material from the conveying cylinders. For this purpose, the proportional valves are opened slowly. Furthermore, after the material to be conveyed has been discharged from the conveying cylinders, the proportional valves 12, 13 can be closed slowly to achieve a smooth transition between discharge and suction. To accelerate the pre-compression, the auxiliary hydraulic pump 6 can apply hydraulic pressure to the differential cylinders 2, 3 via two speed mode valves 17, 18. Here, two check valves 10, 11 are each pressed open by the auxiliary hydraulic pump 6. These check valves 10, 11 of the hydraulic circuit 4 close as soon as a pressure is applied during pre-compression that is higher than the pressure provided by the auxiliary hydraulic pump 6. In addition, the hydraulic circuit 4 has two return valves 19, 20, via which the pressureless return flow of hydraulic fluid into a tank 21 can be enabled or blocked. In addition to the drive lines 15, 16 with the proportional valves 12, 13, the hydraulic circuit 4 has a branch 22 in which a flow control valve 14 is arranged. Via two creep mode valves 23, 24, the hydraulic flow of the main hydraulic pump 5 limited via the flow control valve 14 can thus be applied to the differential cylinders 2, 3 of the differential cylinder drive 1, bypassing the proportional valves 12, 13 in the drive lines 15, 16. Via a swing oil supply valve 25, the swing line 9 connecting the rod sides of the differential pistons 7, 8 in the differential cylinders 2, 3 can be supplied with hydraulic fluid by the auxiliary hydraulic pump 6. This additional swing oil may further be drained toward the tank 21 through a swing oil drain valve 26. The hydraulic circuit 4 also preferably has two pressure gauges 27, 28 which measure the pressure in the drive lines 15, 16 upstream of the differential cylinders 2, 3 of the differential cylinder drive 1. For emergency operation, the hydraulic circuit 4 also has two sensors 29, 20 or initiators at the stop of the differential pistons 7, 8 in the differential cylinders 2, 3. Furthermore, the hydraulic circuit 4 preferably has a displacement measuring system 31, 32 for each of the two differential cylinders 2, 3.

With the hydraulic circuit 4 shown, the piston pump can be driven via the differential cylinder drive 1 in the following cyclically cycled steps:

- Suction of material to be conveyed by means of a first conveying cylinder by driving the associated differential cylinder 2, 3 and simultaneous discharge of material to be conveyed by means of a second conveying cylinder by driving the associated differential cylinder 2, 3,
- pre-compression of the sucked-in material by means of the first conveying cylinder by driving the associated differential cylinder 2, 3 and simultaneous discharge of the material by means of the second conveying cylinder by driving the associated differential cylinder 2, 3,
- discharge of the material by means of the first conveying cylinder by driving the associated differential cylinder 2, 3 and simultaneous suction of material to be conveyed by means of the second conveying cylinder by driving the associated differential cylinder 2, 3,
- discharge of the material to be conveyed by means of the first conveying cylinder by driving the associated differential cylinder 2, 3 and simultaneous pre-compression of the sucked material by means of the second conveying cylinder by driving the associated differential cylinder 2, 3, in order to achieve a continuous conveying of conveyed material by the piston pump. After the pre-compression of the sucked-in material by means of a conveying cylinder by driving the respectively assigned differential cylinder 2, 3 via the hydraulic circuit 4, a discharge of the material by means of the first and the second conveying cylinder can also take place simultaneously by parallel driving of the assigned differential cylinders 2, 3, before a suction of material to be conveyed by means of a conveying cylinder by driving the respectively assigned differential cylinder 2, 3 via the hydraulic circuit 4 is started again. The valve positions in the hydraulic circuit 4 required to operate the piston pump for this purpose are explained with reference to FIGS. 2-7, which show the hydraulic circuit 4 according to FIG. 1 during the individual steps.

Figure 2:
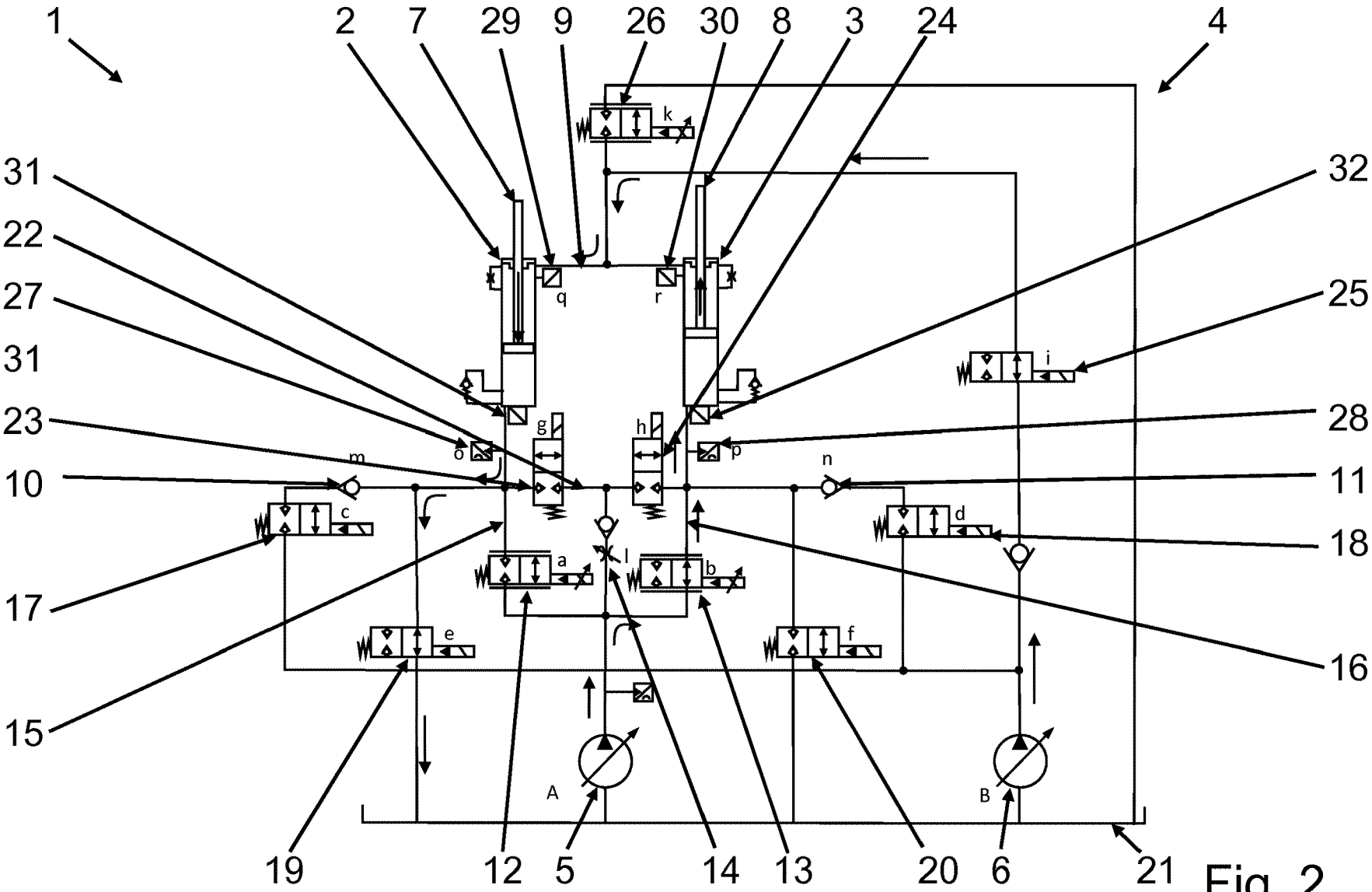

The switching positions of the valves in the hydraulic circuit 4 shown in FIG. 2 provide for suction of material to be conveyed by means of a first conveying cylinder by driving the left differential cylinder 2 and for simultaneous discharge of material to be conveyed by means of a second conveying cylinder by driving the right differential cylinder 3. In the switching positions shown here, the main hydraulic pump 5 supplies hydraulic fluid to the right differential cylinder 3 on the piston side in order to drive the associated conveying cylinder of the piston pump for the discharge of material to be conveyed from the conveying cylinder. For this purpose, the right-hand proportional valve 13 in the right-hand drive line 16 is open and the piston-side effective surfaces of the right-hand differential piston 8 are acted upon by the main hydraulic pump 5 as a result. Via the open swing oil supply valve 25, the left differential piston 7 is additionally acted upon by the auxiliary hydraulic pump 6 to accelerate the suction of material to be conveyed. This additionally accelerates the conveying piston, which is driven by the left differential cylinder 2, during the suction of material to be conveyed. By supplying the rod-side chamber in the differential cylinders 2, 3 with additional swing oil, the piston 7 of the left differential cylinder 2 retracts faster during the suction process. Via the open left return valve 19, the hydraulic fluid displaced by this from the piston side of differential cylinder 2 can simply flow off in the direction of tank 21.

Figure 3:
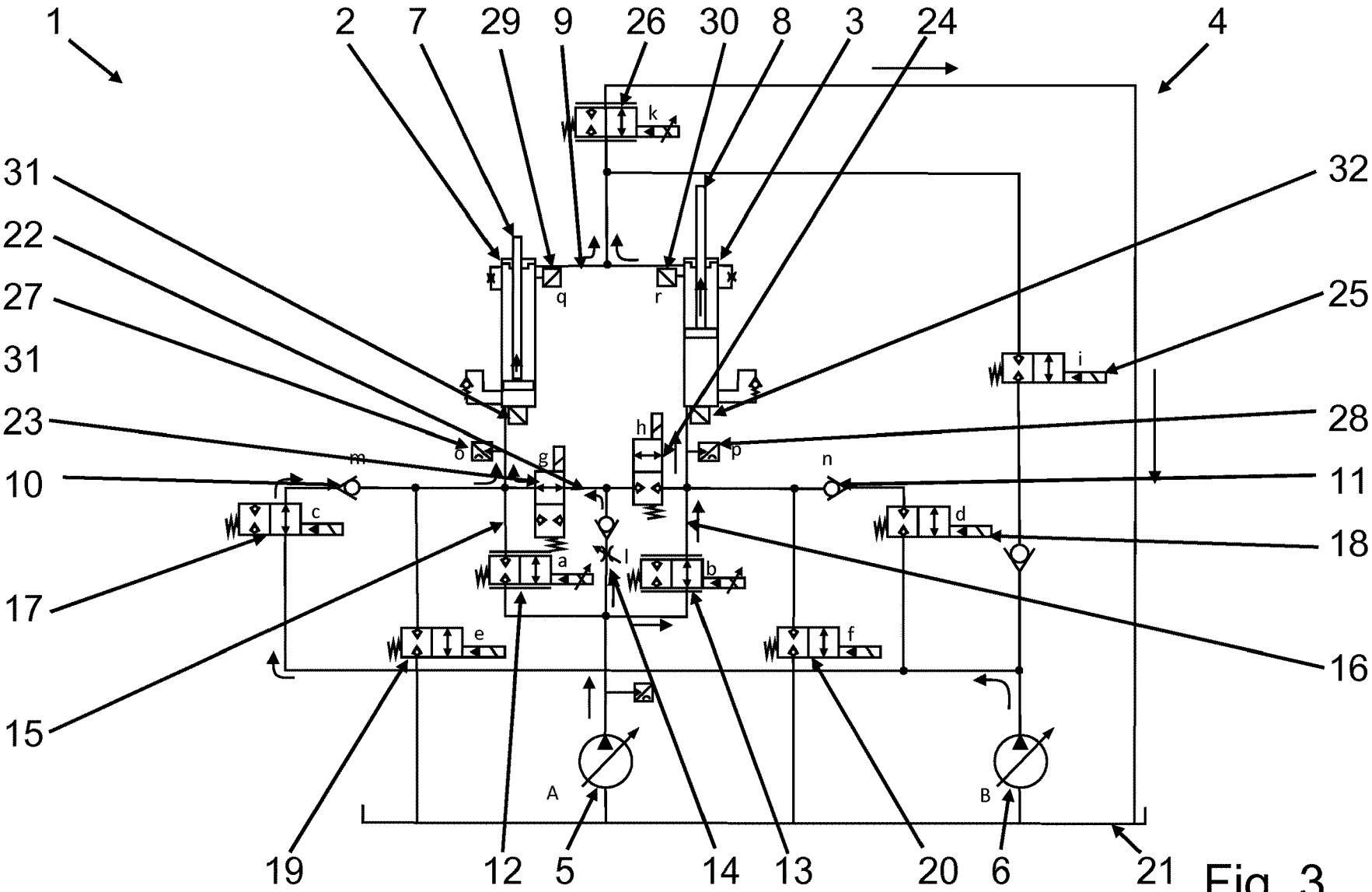

FIG. 3 shows the switching positions of the valves in the hydraulic circuit 4 in a subsequent step. Here, the left differential cylinder 2 is driven for pre-compression of the sucked-in material by means of the first conveying cylinder, while at the same time the right differential cylinder 3 continues to be driven for discharge of the material by means of the second conveying cylinder. In the first phase of pre-compression shown here, the left differential cylinder 2 is driven, i.e. pressurized with hydraulic fluid, by the auxiliary hydraulic pump 6 and the main hydraulic pump 5. For pre-compression of material to be conveyed in the first conveying cylinder, the left differential cylinder 2 is pressurized by the hydraulic circuit 4 through the auxiliary hydraulic pump 6 via a check valve 10 of the hydraulic circuit 4 and simultaneously by the main hydraulic pump 5 via a flow control valve 14 of the hydraulic circuit 4. In this first phase of pre-compression, the auxiliary hydraulic pump 6 provides a higher volume flow of hydraulic fluid at a lower pressure compared to the main hydraulic pump 5 via the hydraulic circuit 4 to drive the left differential cylinder 2. In this case, the auxiliary hydraulic pump 6 presses open the left check valve 10 as long as a pressure is present during pre-compression that is lower than the pressure provided by the auxiliary hydraulic pump 6. Thus, during the pre-compression of material to be conveyed in the conveying cylinder, the left differential cylinder 2 is pressurized by the hydraulic circuit 4 through the auxiliary hydraulic pump 6 via the check valve 10 and at the same time is driven with hydraulic fluid by the main hydraulic pump 5 via a flow control valve 14 of the hydraulic circuit 4. For this purpose, the left creep mode valve 23 is open while the right creep mode valve 24 is closed. The oil from the auxiliary hydraulic pump 6 overcomes the check valve 10 as long as the pre-compression pressure is still low and the oil pressure of the auxiliary hydraulic pump 6 at the check valve 10 is greater than the pressure building up from the main hydraulic pump 5 in the left differential cylinder 2 during pre-compression. As a result, pre-compression is accelerated and pre-compression can be completed before the right differential cylinder 3 reaches the stop when discharging material from the associated conveying cylinder. During this phase, the flow control valve 14 ensures that only a constant minimum amount of hydraulic fluid is used by the main hydraulic pump 5 for pre-compression by the left differential cylinder 2. As a result, the hydraulic fluid pressure drop and thus the flow rate drop for the still pumping right cylinder 3 are minimal when the main hydraulic pump 5 simultaneously contributes to the pre-compression. During pre-compression, the main hydraulic pump 5 could also be readjusted via a control algorithm. The amount of hydraulic fluid withdrawn from the main hydraulic pump 5 for pre-compression may also be readjusted at the main hydraulic pump 5. The flow control valve 14 preferably includes a pressure compensator, so that the pressure difference $\Delta p$ across the flow control valve 14 always remains constant. Therefore, the quantity flowing over the flow control valve 14 always remains constant, regardless of the level of the pressures upstream and downstream of the flow control valve 14. The excess swing oil in this phase is drained off to the tank 21 via the open swing oil drain valve 26. In order to be able to meter the discharge of the excess swing oil precisely, the swing oil drain valve 26 is preferably designed as a proportional valve.

Figure 4:
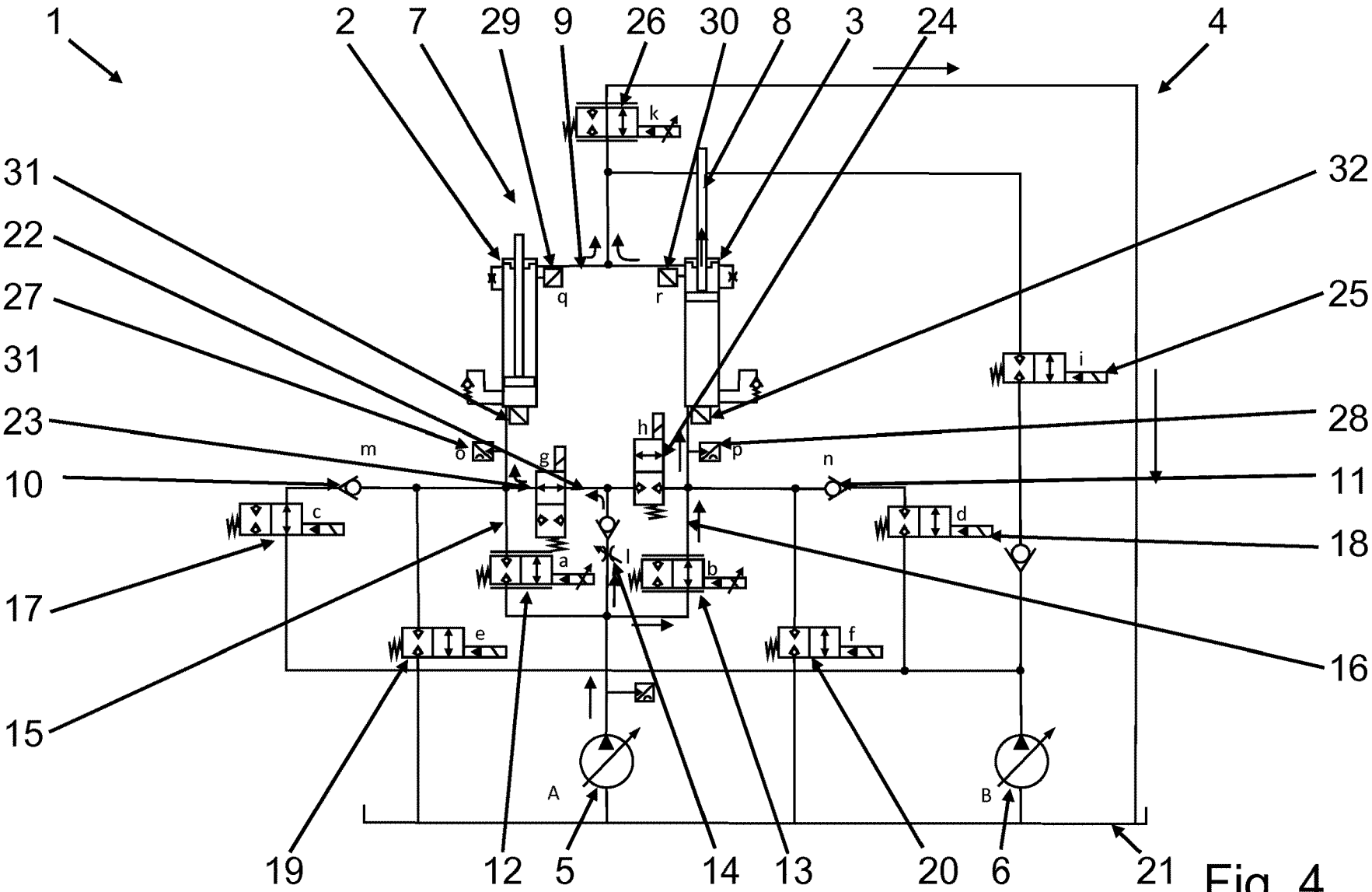

FIG. 4 shows the switching positions of the valves in the hydraulic circuit 4 in a subsequent step. Here, the left differential cylinder 2 continues to be driven for pre-compression of the sucked-in material by means of the first conveying cylinder, while at the same time the right differential cylinder 3 is also driven for discharge of the material to be conveyed by means of the second conveying cylinder. In the second phase of pre-compression shown here, the left differential cylinder 2 is driven only by the main hydraulic pump 5. The left check valve 10 in the hydraulic circuit 4 closes because the pressure generated during pre-compression is higher than the pressure provided by the auxiliary hydraulic pump 6. The auxiliary hydraulic pump 6 no longer contributes to the pre-compression in this phase, since its hydraulic pressure would be insufficient anyway. This represents the transition from the first phase of pre-compression to the second phase of pre-compression. The main hydraulic pump 5 now continues to increase the pressure in the piston-side chamber of the left differential cylinder 2 on its own while also continuing to supply the right pumping differential cylinder 3. During the second phase of pre-compression of the sucked in material the one conveying cylinder, the left differential cylinder 2 and, for simultaneous discharge of the material from the other conveying cylinder, the right differential cylinder 3 are supplied with equal pressure by the main hydraulic pump 5 via the hydraulic circuit 4. At the end of this second phase of pre-compression, an equal pressure is thereby established in the two differential cylinders 2, 3. At the end of pre-compression, this equal pressure is determined by pressure measurement with pressure gauges 27, 28, so that the transition to the next phase can take place in the next step. At the same time, the pre-compression pressure thus also reaches the conveying line pressure of the concrete, which is why an outlet slide valve on the conveying cylinder can be switched over more easily when there is equal pressure on its inlet and outlet side. The excess swing oil in this phase is discharged to tank 21 via the open swing oil drain valve 26.

Figure 5:
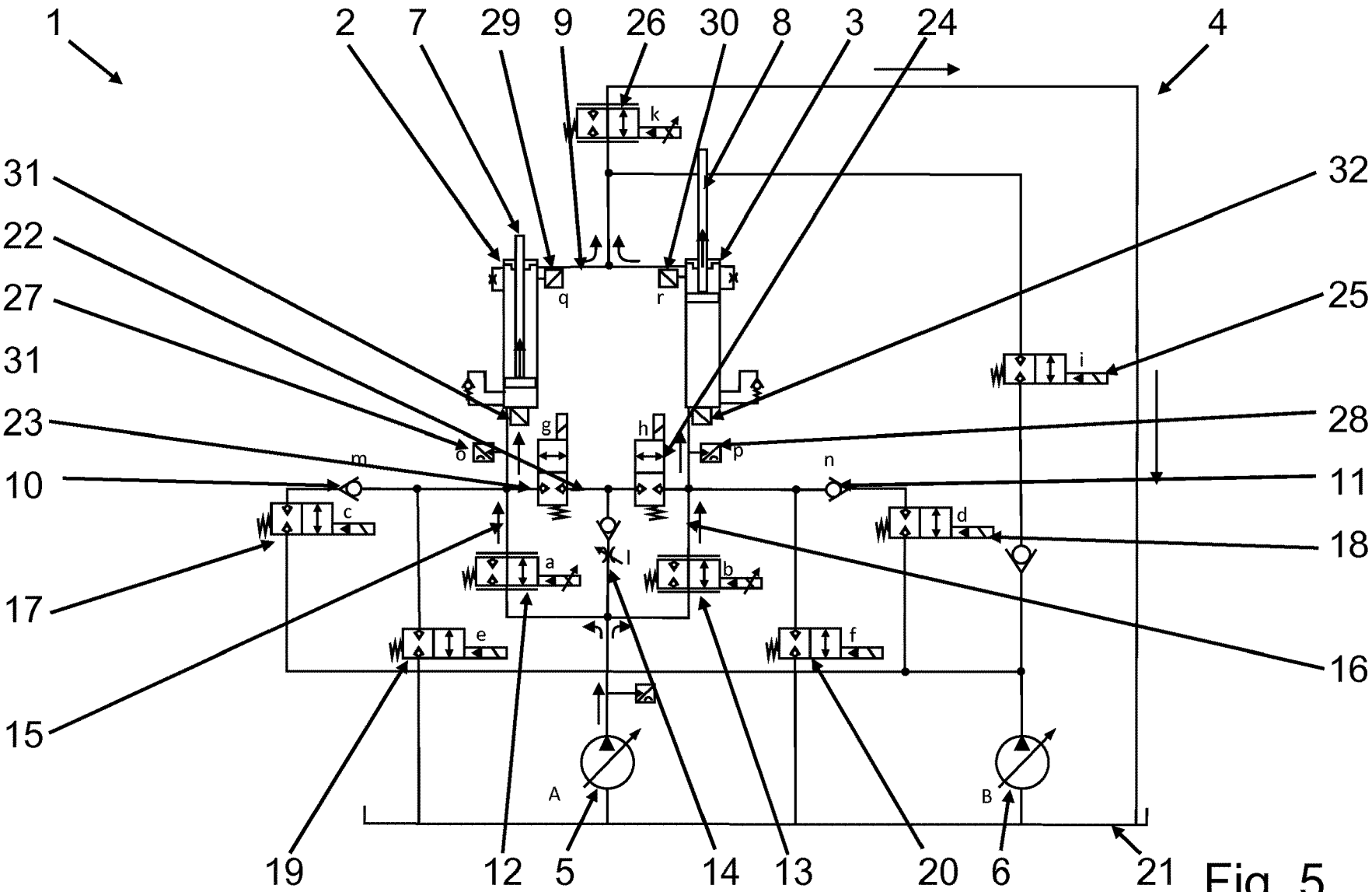

FIG. 5 shows the switching positions of the valves in the hydraulic circuit 4 in a subsequent step. Here, the left proportional valve 12 in the left drive line 15 is opened slowly to realize a particularly smooth transition between pre-compression and discharge of the pre-compressed material via the left differential cylinder 2. At the same time, the right proportional valve 13 in the right drive line 16 is slowly closed so that the right differential cylinder 3 can slowly end the pumping process. In this phase, discharge of the material by means of the first and second conveying cylinders takes place simultaneously by parallel drive of the right-hand 3 and left-hand differential cylinders 2. The excess swing oil in this phase is discharged to the tank 21 via the open swing oil drain valve 26.

Figure 6:
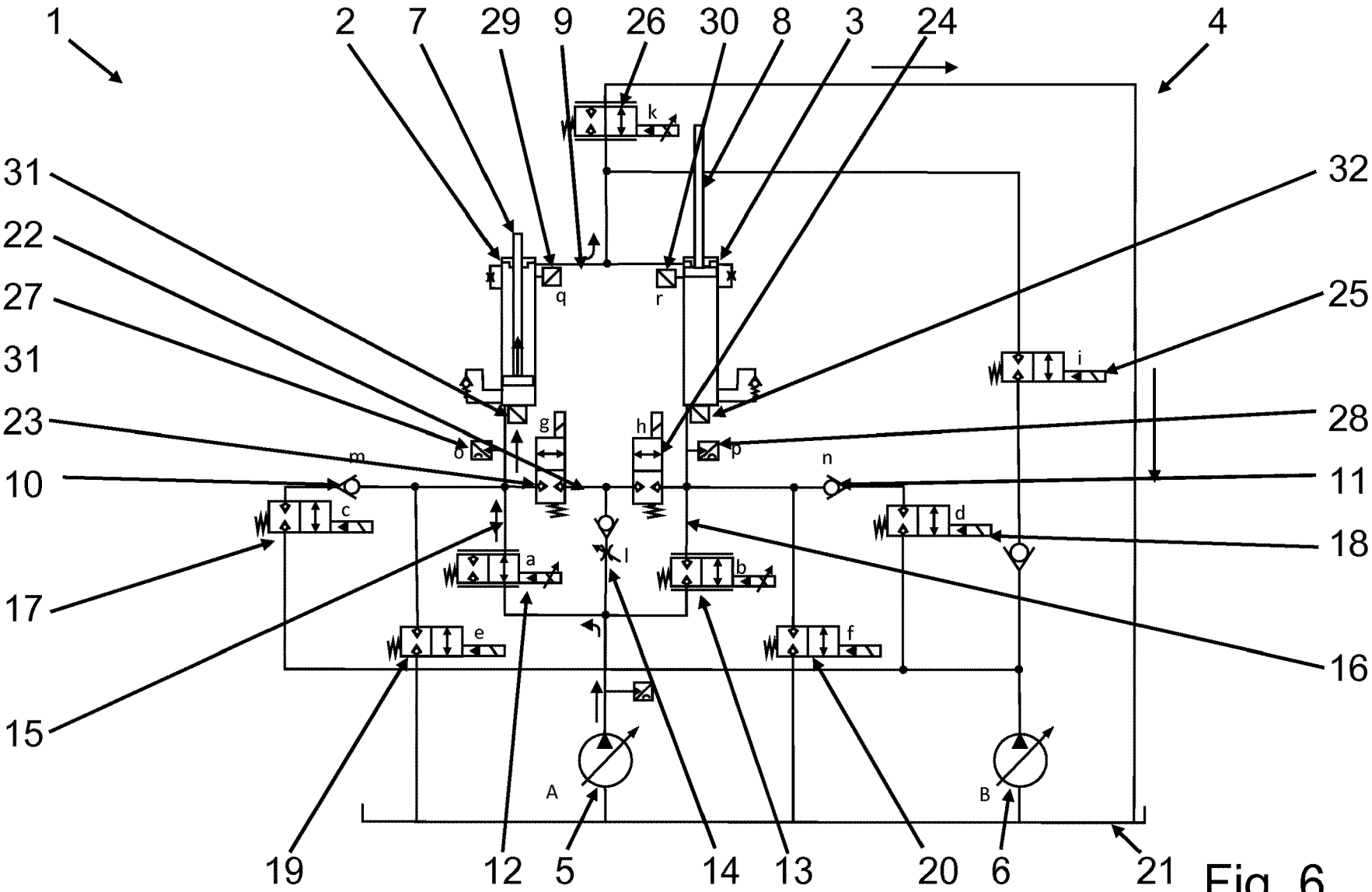

FIG. 6 shows the switching positions of the valves in hydraulic circuit 4 at a subsequent step. Here, the right differential cylinder 3 has reached the stop, which is detected by the displacement sensor 32 and alternatively by the sensor 30. The right proportional valve 13 in the drive line 16 of the right differential cylinder 3 now closes, while the left proportional valve 12 in the drive line 15 of the left differential cylinder 2 is fully open. From now on, the left differential cylinder 2 takes over the pumping operation and the conveyance of material into the conveying line alone, and the right differential cylinder 3 goes over to driving the suction operation for the associated conveying cylinder.

Figure 7:
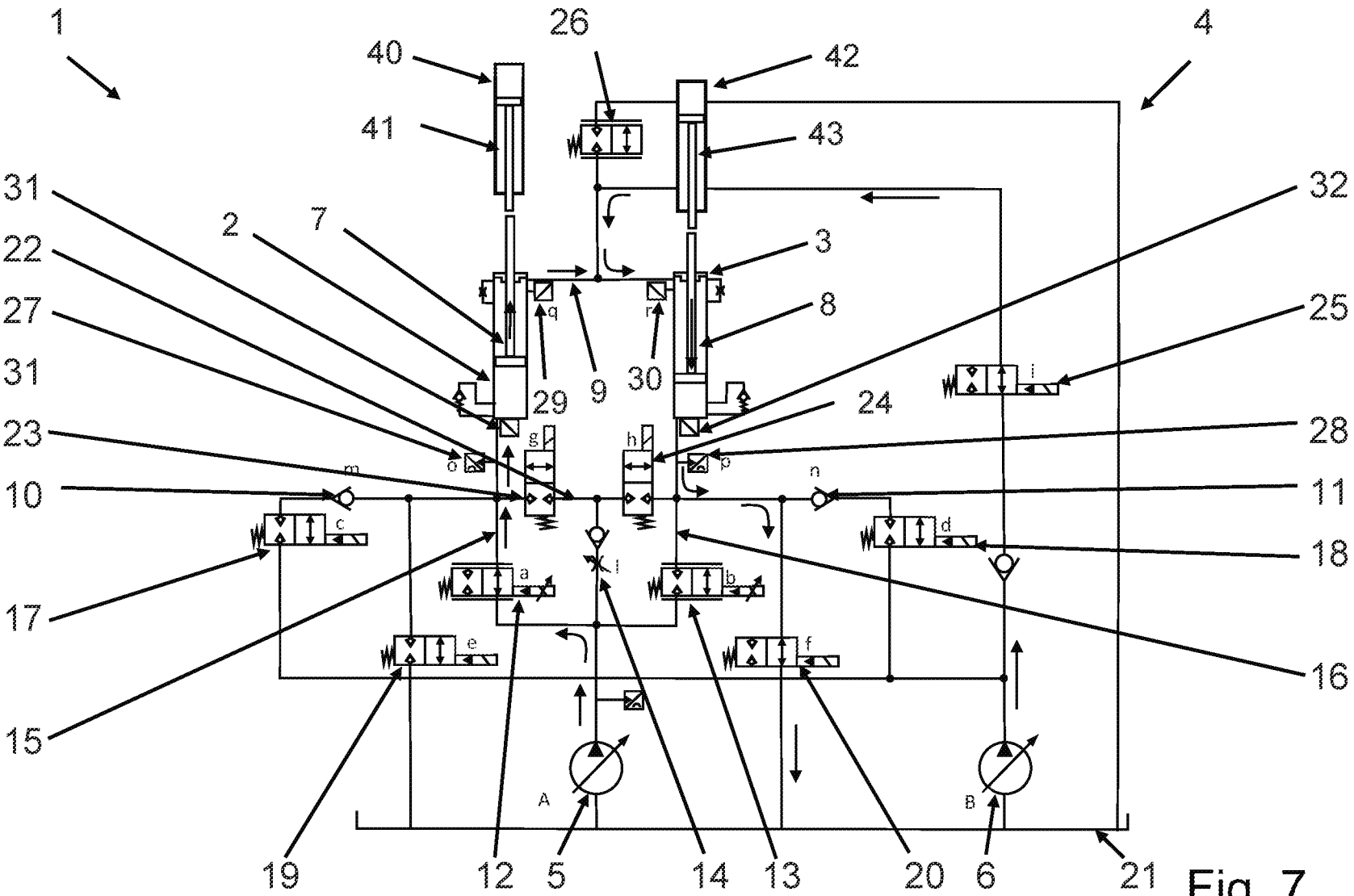

FIG. 7 shows the switching positions of the valves in the hydraulic circuit 4 in a subsequent step. The switching positions of the valves in the hydraulic circuit 4 shown here provide for discharge of material to be conveyed by means of the first conveying cylinder 40 (having a first conveying piston 41) by driving the left differential cylinder 2 and for simultaneous suction of material to be conveyed by means of the second conveying cylinder 42 by driving the right differential cylinder 3. In the switching positions shown here, the main hydraulic pump 5 supplies hydraulic fluid to the left differential cylinder 2 on the piston side in order to drive the associated conveying cylinder of the piston pump for the discharge of material to be conveyed from the conveying cylinder. For this purpose, the left-hand proportional valve 12 in the left-hand drive line 15 is open and the piston-side effective surface of the left-hand differential piston 7 is acted upon by the main hydraulic pump 5. Via the open swing oil supply valve 25, the right differential piston 8 is additionally acted upon by the auxiliary hydraulic pump 6 to accelerate the suction of material to be conveyed. This additionally accelerates the second conveying piston 43, which is driven by the right differential cylinder 3, during the suction of material to be conveyed. By supplying the rod-side chamber in the differential cylinders 2, 3 with additional swing oil, the piston 8 of the right-hand differential cylinder 3 retracts faster during the suction process. Via the open right return valve 20, the hydraulic fluid displaced by this from the piston side of differential cylinder 3 can simply flow off in the direction of tank 21. After the material to be conveyed has been sucked in by means of the second conveying cylinder by driving the right differential cylinder 3, pre-compression then takes place analogously in the second conveying cylinder via the hydraulic circuit 4.

FIG. 8 shows a simple pressure relief circuit 33 for auxiliary hydraulic pump 6. The pressure relief circuit 33 shown here has a pressure relief valve 34 downstream of which a pilot valve 35 for high pressure is connected. A pilot valve 37 for low pressure can be used via a changeover circuit 36 to limit the hydraulic pressure of the auxiliary hydraulic pump 6 and to discharge excess hydraulic fluid in the direction of the tank 21. The pressure limiting circuit 33 shown here also has a hydraulic accumulator 38 downstream of which a pressure limiter 39 is connected.

—Reference Sign List—

LIST OF REFERENCE SIGNS

1 Differential cylinder drive
2 Differential cylinder L
3 Differential cylinder R
4 Hydraulic circuit
5 Main hydraulic pump (A), main hydraulic source
6 Auxiliary hydraulic pump (B), auxiliary hydraulic source
7 Differential piston L
8 Differential piston R
9 Swing line
10 Check valve L (m)
11 Check valve R (n)
12 Proportional valve L (a)
13 Proportional valve R (b)
14 Flow control valve (I)
15 Drive line L
16 Drive line R
17 speed mode valve L (c)
18 speed mode valve R (d)
19 Return valve L (e)
20 Return valve R (f)
21 Tank
22 Branch
23 Creep mode valve L (g)
24 Creep mode valve R (h)
25 swing oil supply valve (i)
26 swing oil drain valve (k)
27 Pressure gauge L (o)
28 Pressure gauge R (p)
29 Sensor L (q)
30 Sensor R (r)
31 displacement measuring system L (s)
32 displacement measuring system R (t)
33 Pressure relief circuit
34 Pressure relief valve
35 Pilot valve (high pressure)
36 Changeover circuit
37 Pilot valve (low pressure)
38 Hydraulic accumulator
39 Pressure relief

The invention claimed is:

1. A method for operating a piston pump with a differential cylinder drive with a first differential cylinder and a second differential cylinder for respectively driving a first conveying piston and a second conveying piston respectively movable in a first conveying cylinder and a second conveying cylinder, the first conveying cylinder being driven via the first differential cylinder of the differential cylinder drive, the second conveying cylinder being driven via the second differential cylinder of the differential cylinder drive, with a hydraulic circuit for controlling the differential cylinder drive and/or for driving the differential cylinder drive by action of hydraulic fluid, the method comprising the following cyclically performed steps:

suctioning material to be conveyed via the first conveying cylinder by driving the first differential cylinder and simultaneously discharging material to be conveyed via the second conveying cylinder by driving the second differential cylinder;

pre-compressing the sucked-in material via the first conveying cylinder by driving the first differential cylinder and simultaneously discharging material via the second conveying cylinder by driving the second differential cylinder;

discharging material via the first conveying cylinder by driving the first differential cylinder and simultaneously suctioning material to be conveyed via the second conveying cylinder by driving the second differential cylinder; and discharging material via the first conveying cylinder by driving the first differential cylinder and simultaneously pre-compressing the sucked-in material via the second conveying cylinder by driving the second differential cylinder, wherein the pre-compressing steps are divided into at least two phases, wherein in a first phase the hydraulic circuit causes pre-compression using a first conveying piston speed by controlling the hydraulic fluid at a first volume flow and a first pressure, wherein in a second phase the hydraulic circuit causes pre-compressing using a second conveying piston speed, which is lower than the first conveying piston speed, by controlling a second volume flow and a second pressure, wherein the second volume flow is lower than the first volume flow and the second pressure is higher than the first pressure.

2. The method of claim 1, wherein the hydraulic circuit comprises a main hydraulic source for applying hydraulic fluid to the first and second differential cylinders to pre-compress the sucked-in material and to simultaneously discharge material from the second conveying cylinder.

3. The method of claim 1, wherein after the pre-compressing of the sucked-in material, the method further comprises discharging material via the first and the second conveying cylinders simultaneously by parallel driving of the associated differential cylinders, before suctioning material to be conveyed.

4. The method of claim 1, wherein the hydraulic circuit comprises a main hydraulic source for acting on the first and second differential cylinders with the hydraulic fluid when material to be conveyed is sucked into the first and second conveying cylinders by the first and second conveying pistons and sucked material is discharged from the first and second conveying cylinders by the first and second conveying pistons, and an auxiliary hydraulic source for driving the first and second differential cylinders when material to be conveyed is pre-compressed in the first and second conveying cylinders in the time between the suction of material to be conveyed and expulsion of pre-compressed material.

5. The method of claim 4, wherein in the first phase the auxiliary hydraulic source and the main hydraulic source cause pre-compression of the sucked-in material, and in the second phase only the main hydraulic source causes the pre-compression of the sucked-in material.

6. The method of claim 5, wherein application of equal pressure by the main hydraulic source is established in the first and second differential cylinders at the end of the second phase of the pre-compression before the discharge of pre-compressed material from the conveying cylinder which has completed the pre-compression is started.

7. The method of claim 4, wherein the first and second differential cylinders are additionally acted upon by the auxiliary hydraulic source for driving the first and second conveying pistons via the hydraulic circuit during the suction to accelerate the suction of material to be conveyed.

8. The method of claim 7, wherein the additional acting of the first and second differential cylinders for accelerating the suction of material to be conveyed from the auxiliary hydraulic source takes place on respective rod-side working surfaces of the first and second differential pistons of the first and second differential cylinders, wherein respective rod sides of the first and second differential pistons are connected via a swing line which is connected by the hydraulic circuit to the auxiliary hydraulic source.

9. The method of claim 8, wherein the first and second differential cylinders are acted upon by the hydraulic circuit on respective piston-side working surfaces of the first and second differential pistons when material to be conveyed is discharged from the first and second conveying cylinders by the main hydraulic source.

10. The method of claim 4, wherein the auxiliary hydraulic source, during the first phase of pre-compression, provides a higher volume flow of hydraulic fluid but a lower pressure compared to the main hydraulic source when driving the first and second differential cylinders.

11. The method of claim 4, wherein a check valve in the hydraulic circuit closes after a pressure of the hydraulic fluid is present during the pre-compression which is higher than pressure provided by the auxiliary hydraulic source, the closing of the check valve representing transition from the first phase of the pre-compression to the second phase of the pre-compression.

12. The method of claim 11, wherein the auxiliary hydraulic source presses the check valve open during the pressurization of the first and second differential cylinders in the first phase of the pre-compression.

13. The method of claim 11, wherein respective drive lines between the first and second differential cylinders and the main hydraulic source are controllable via proportional valves, wherein the proportional valves are opened slowly at the end of the second phase of the pre-compression after the equal pressure has been reached respectively in the first and second differential cylinders for discharging pre-compressed material from the first and second conveying cylinders and being closed slowly after the material to be conveyed has been discharged from the first and second conveying cylinders.

14. The method of claim 4, wherein the first and second differential cylinders for pre-compression of material to be conveyed in the first and second conveying cylinders by the first and second conveying pistons are acted upon with hydraulic fluid by the auxiliary hydraulic source via a check valve of the hydraulic circuit and simultaneously by the main hydraulic source via a flow control valve of the hydraulic circuit.

15. The method of claim 4, wherein during the pre-compressing of material to be conveyed in one conveying cylinder, the other conveying cylinder is driven for discharge of material to be conveyed via the associated differential cylinder, the associated differential cylinder being acted upon by the hydraulic circuit by the main hydraulic source of the hydraulic circuit for supplying the associated differential cylinder with the hydraulic fluid from the main hydraulic source via a drive line branching off upstream of a flow control valve.

16. The method of claim 15, wherein for simultaneous discharge of material to be conveyed from the first and second conveying cylinders, the associated differential cylinders are supplied with the hydraulic fluid in parallel via separate drive lines from the main hydraulic source bypassing the flow control valve from the hydraulic circuit.

17. A piston pump comprising:

a differential cylinder drive with first and second differential cylinders that are configured and arranged to drive respective first and second conveying pistons that are movable in respective first and second conveying cylinders, each of the first and second conveying pistons arranged to be driven via respective first and second differential cylinders for operating the piston pump, a hydraulic circuit is configured to control the differential cylinder drive and/or to drive the differential cylinder drive by the action of hydraulic fluid, wherein the hydraulic circuit is controlled to effect:

in a first phase, pre-compression of sucked-in material in at least one of the first and second conveying cylinders at a first conveying piston speed by acting on the associated differential cylinder with the hydraulic fluid at a first volume flow and at a first pressure, and in a second phase, pre-compression of the sucked-in material in the at least one of the first and second conveying cylinders at a second conveying piston speed, which is lower than the first conveying piston speed, by acting on the associated differential cylinder at a second volume flow and at a second pressure, wherein the second volume flow is lower than the first volume flow and the second pressure is higher than the first pressure.

18. The piston pump of claim 17, wherein the hydraulic circuit has at least one main hydraulic source for driving the differential cylinders to be acted upon the differential cylinders at least at times simultaneously by the main hydraulic source with hydraulic fluid under equal pressure for driving the first conveying pistons from the hydraulic circuit.

19. The piston pump of claim 17, wherein the hydraulic circuit comprises:

a main hydraulic source configured to drive the first and second differential cylinders when material to be conveyed is sucked into the first and second conveying cylinders and when sucked material is discharged from the first and second conveying cylinders; and an auxiliary hydraulic source configured to drive the first and second differential cylinders during pre-compression material to be conveyed in the first and second conveying cylinders before discharge of pre-compressed material, wherein each of the first and second differential cylinders, at least at times, for pre-compression in the associated conveying cylinder, can be acted upon simultaneously by the main hydraulic source and the auxiliary hydraulic source from the hydraulic circuit with the hydraulic fluid.

* * * * *